US005102133A

United States Patent [19]

Chilton et al.

[11] Patent Number: 5,102,133

[45] Date of Patent: Apr. 7, 1992

[54] INTERRUPTED INVERTED JUMP LOOP FOR ELECTRIC SLOT CARS

[75] Inventors: Seth M. Chilton, Haddonfield; Neil Tilbor, Medford, both of N.J.

[73] Assignee: Tyco Industries, Inc., Mount Laurel, N.J.

[21] Appl. No.: 654,421

[22] Filed: Feb. 12, 1991

[51] Int. Cl.[5] ..... A63H 18/02; A63H 18/12

[52] U.S. Cl. ..... 273/86 B; 446/444; 104/54; 104/55

[58] Field of Search ..... 273/86 R, 86 B, 86 C; 446/444, 445, 441, 168; 104/53, 54, 55, 56; 238/10 E, 10 F

[56] References Cited

U.S. PATENT DOCUMENTS

| | | | |
|---|---|---|---|
| Re. 32,106 | 4/1986 | Lemelson | 446/138 |
| 770,071 | 9/1904 | Johnson | 104/55 |
| 783,812 | 2/1905 | Ancillotti | 104/54 |
| 3,209,491 | 10/1965 | Roeper | 273/86 R |
| 4,146,991 | 4/1979 | Sano | 46/202 |
| 4,383,688 | 5/1983 | Prebodka | 273/86 B |
| 4,394,961 | 7/1983 | Mueller | 238/10 R |
| 4,531,966 | 4/1985 | Mucaro et al. | 273/68 B |
| 4,919,052 | 4/1990 | Yoneda et al. | 104/54 |

FOREIGN PATENT DOCUMENTS

| | | | |
|---|---|---|---|
| 1551582 | 8/1979 | United Kingdom | 238/10 F |
| 2200297 | 8/1988 | United Kingdom | 238/10 F |

*Primary Examiner*—William H. Grieb
*Assistant Examiner*—William M. Pierce
*Attorney, Agent, or Firm*—Panitch Schwarze Jacobs & Nadel

[57] ABSTRACT

An interrupted inverted jump loop for an electric toy vehicle track, including a first generally arcuate slotted track for launching an electric toy vehicle into the air to carry out an upside-down free-flying jump and a second generally arcuate slotted track spaced from and suitably aligned with the first slotted track for catching the electric toy vehicle after it is traversed through the air. A portion of the first slotted track is electrically powerless for allowing the electric toy vehicle to freely launch towards the second slotted track.

13 Claims, 6 Drawing Sheets

INTERRUPTED INVERTED JUMP LOOP FOR ELECTRIC SLOT CARS

FIELD OF THE INVENTION

The present invention relates to a track for powered toy vehicles and, more particularly, to an interrupted inverted jump loop for an electric toy track in which an electric toy vehicle is launched into the air and is caught after it has traversed through the air.

BACKGROUND OF THE INVENTION

Interrupted inverted jump loops in which a vehicle travels through the air are generally known. For instance one such conventional jump loop includes two spaced apart and suitably aligned curved runways that form an interrupted inverted jump loop between which a vehicle, such as a bicycle can carry out an upside-down free-flying jump. The bicycle, initially situated in an elevated position, travels down a first curved runway from which the bicycle is launched, toward a second curved runway. If the jump is successful, the bicycle will have traversed upside down through the interrupted portion of the jump loop Although the concept of an interrupted inverted jump loop for vehicles is generally known, problems exist in creating a jump loop in which electric toy vehicles can successfully carry out an upside-down free-flying jump and then subsequently continue onward.

One of the problems inherent in an interrupted inverted jump loop has been to design a jump loop in which electric toy vehicle has enough speed to carry out the jump, but not too much speed. Too much speed may result in the vehicle missing the second curved runway after it has traversed through the interrupted portion of the jump loop. Further, too much speed may cause the vehicle to land in an uncontrolled manner.

The problem of too much speed is especially prevalent if an electric toy vehicle, such as an electric toy automobile, carries out such a jump on an electric toy track. With standard electric toy vehicles speed is easily acquired. Electricity or power is provided to the electric toy vehicle through electrically conductive elements located on or embedded in the surface of the track. In this type of electric toy track, it is difficult to finely adjust the amount of power supplied to the electric toy vehicle. This often results in the electric toy vehicle either receiving too much or too little power to complete the jump and continue onward.

Further, if the electric toy vehicle is fully powered as it leaves the first curved runway, the armature of the electric toy vehicle motor rotates at high revolutions per minute (e.g., 10,000 r.p.m.). The high speed rotation of the armature results in what is commonly referred to as "motor steer." That is, the centrifugal forces created by the rotating armature result in torque being applied to the body and frame of the vehicle about the longitudinal axis thereof This torque forces the vehicle to spin about the longitudinal axis. Thus, the vehicle turns over during the interrupted portion of the jump loop and lands upside down or on the roof thereof.

Moreover, incorporating an interrupted inverted jump loop in an electric toy track electric toy vehicles, requires that electric power be provided to the electrically conductive elements located on or imbedded in the surface of the track. Since there is an interrupted portion in the jump loop, alternate means must be provided for creating a complete electrical circuit.

Often, a pair of electric toy vehicles are used on a slotted electric toy track for the purpose of having the electric toy vehicles race one another. If the two electric toy vehicles are to carry out free-flying upside-down jumps, additional problems arise. The use of two electric toy vehicles requires that the track be designed to ensure that the electric toy vehicles successfully carry out the jump and land in the correct lane to continue racing.

The present invention overcomes many of the disadvantages inherent in the above-described interrupted inverted jump loops by providing an electric toy track in which electric toy vehicles can carry out an upside-down free-flying jump The interrupted inverted jump loop of the present invention does not provide power to the electric toy vehicle just prior to launching from the first curved runway to prevent the electric toy vehicle from traveling at excessive speed and to prevent the same from twisting due to motor steer. The interrupted inverted jump loop of the present invention includes tapered slots and lanes for guiding the electric toy vehicles to the correct lane on the second curved runway. Consequently, use of the present invention enables electric toy vehicles to successfully carry out the jump and subsequently continue forward on the electric toy track.

SUMMARY OF THE INVENTION

Briefly stated, the present invention is for an interrupted inverted jump loop for an electric toy vehicle track. The interrupted inverted jump loop comprises a first generally arcuate slotted track for launching an electric toy vehicle into the air to carry out an upside-down free-flying jump and a second generally arcuate slotted track spaced from and suitably aligned with the first slotted track for catching the electric toy vehicle after it has traversed through the air.

BRIEF DESCRIPTION OF THE DRAWINGS

The foregoing summary, as well as the following detailed description of the presently preferred embodiment of the invention will be better understood when read in conjunction with the appended drawings. For the purpose of illustrating the invention, there is shown in the drawings, an embodiment which is presently preferred. It should be understood, however, that the present invention is not limited to the particular arrangement and instrumentality shown. In the drawings.

DETAILED DESCRIPTION OF THE PREFERRED EMBODIMENT

Figure 1:
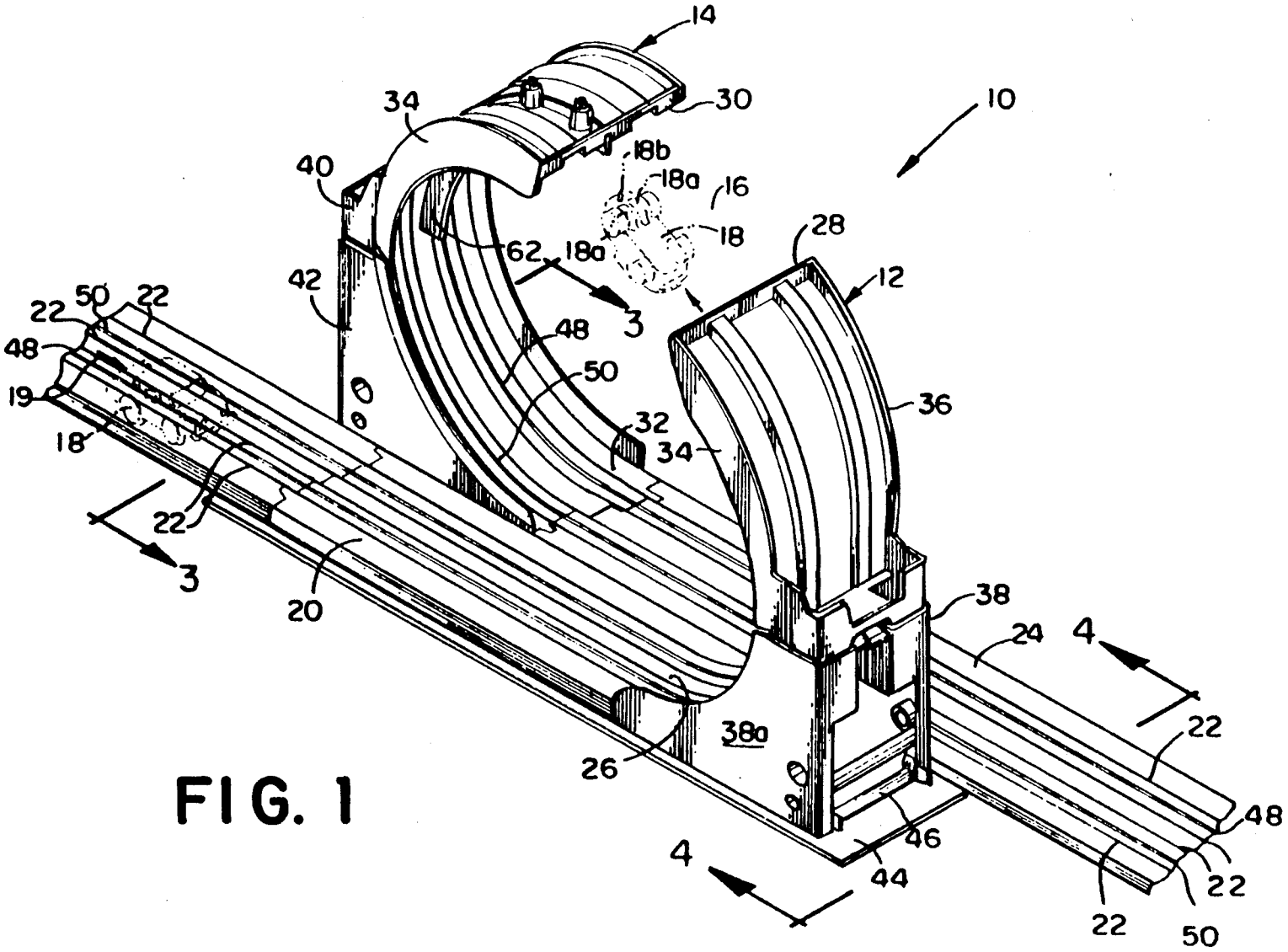
FIG. 1 is a perspective view of an interrupted inverted jump loop for an electric toy vehicle track in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the interrupted inverted jump loop and designated parts thereof. The terminology includes the words above specifically mentioned, derivatives thereof and words of similar import.

Referring to the drawings in detail, wherein like numerals indicate like elements throughout, there is shown in FIGS. 1 through 5 a preferred embodiment of an interrupted inverted jump loop, generally designated 10. for an electric toy vehicle track in accordance with the present invention. FIG. 1 is a perspective view of the interrupted inverted jump loop 10, hereinafter referred to as the "jump loop" 10. The jump loop 10 includes a first generally arcuate slotted track 12 for launching an electric toy vehicle 18 (shown in phantom) into the air to carry out an upside-down free-flying jump. A second generally arcuate slotted track 14 is spaced from and suitably aligned with the first slotted track 12 for catching the electric-toy vehicle 18 after it has traversed through the air or interrupted portion 16 between the first slotted track 12 and the second slotted track 14.

Since the interrupted inverted jump loop 10 is for an electric toy vehicle track, it is constructed of a durable material which is capable of withstanding the rigors of a child's play. Accordingly, in the preferred embodiment of the invention, the various elements of the jump loop 10 are constructed of a high impact polystyrene using an injection molding process, except as indicated otherwise However, it is understood by those skilled in the art that the various elements of the jump loop 10 can be fabricated of other materials or of more than one material. For instance, the radially inwardly extending walls of the first and second slotted tracks 12 and 14 could be constructed of a relatively flexible plastic for allowing the toy vehicle 18 to bounce off the walls and return to the appropriate slot, as described hereinafter.

Figure 2:
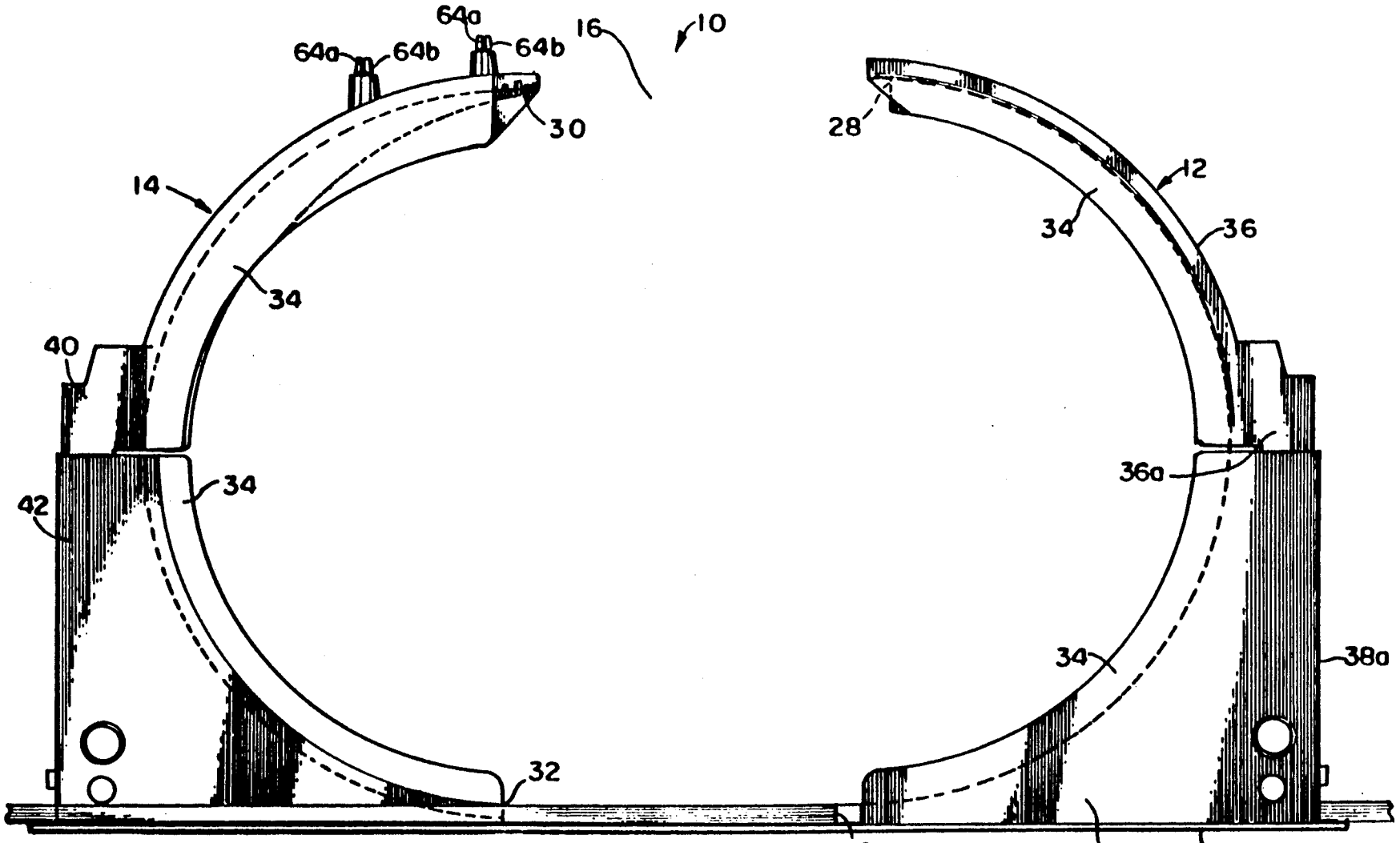
FIG. 2 is a front elevational view of the interrupted inverted jump loop of FIG. 1.
Figure 5:
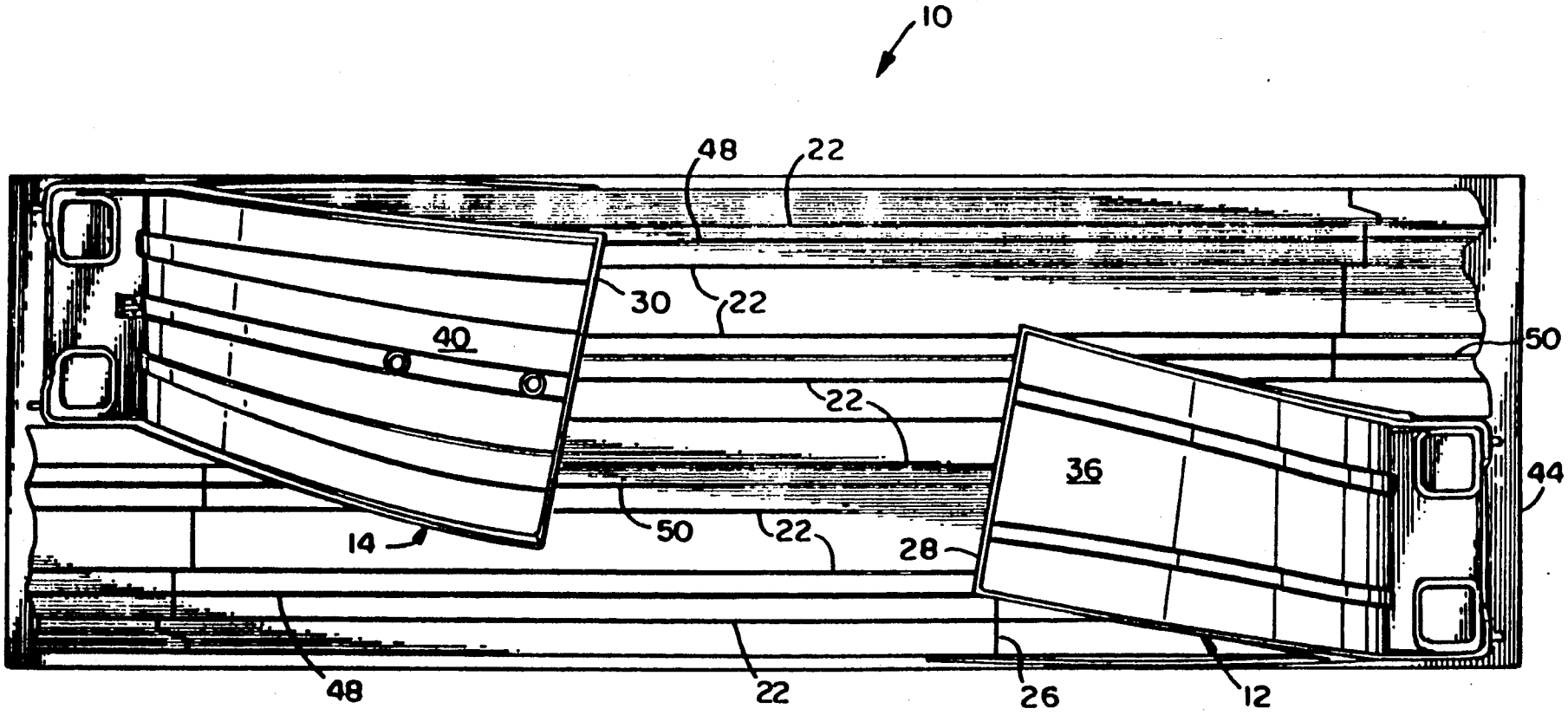
FIG. 5 is a partial top plan view of the interrupted inverted jump loop shown in FIG. 1.

As shown in FIGS. 1, 2 and 5, the first slotted track 12 includes a point of entry 26 and a point of departure 28. Similarly, the second slotted track 14 includes a point of reentry 30 and a point of departure 32. As best shown in FIG. 5, the width of the point of departure 28 of the first slotted track 12 is greater than the width of the point of entry 26. The width of the point of reentry 30 is also greater than the point of departure 32 of the second slotted track 14. The presence of greater widths combined with the walls 34 extending radially inwardly from the side edges of both the first slotted track 12 and the second slotted track 14 creates a funnel for both the point of departure 28 and the point of reentry 30 which assists in the launching and landing of the toy vehicle 18, as described in more detail hereinafter.

Referring now to FIGS. 1 and 2, the first slotted track 12, in the preferred embodiment of the invention, includes an upper portion 36 and a lower portion 38. The point of departure 28 is located on the upper end of the upper portion 36 and the point of entry 26 is located on the lower end of the lower portion 38. The lower portion 38 of the first slotted track 12 includes a support member **38*a* for positioning the first slotted track 12 on a base 44 for providing the jump loop 10 with stability. The upper end of the lower portion 38 includes apertures (not shown) extending downwardly therethrough for receiving a pair of complimentarily sized fingers 36*a* extending downwardly from the lower end of the upper portion 36. This allows the upper portion 36 to be releasably mounted on the lower portion 38** for purposes of convenient packing.

While in the present embodiment, it is preferred that the slotted track 12 be comprised of upper and lower portions 36, 38, it is understood by those skilled in the art that the first slotted track could be of single piece construction without departing from the spirit and scope of the invention. Furthermore, interlock means could be incorporated between the upper portion 36 and the lower portion 38 for insuring that the upper and lower portions 36, 38 do not inadvertently separate during use.

Figure 4:
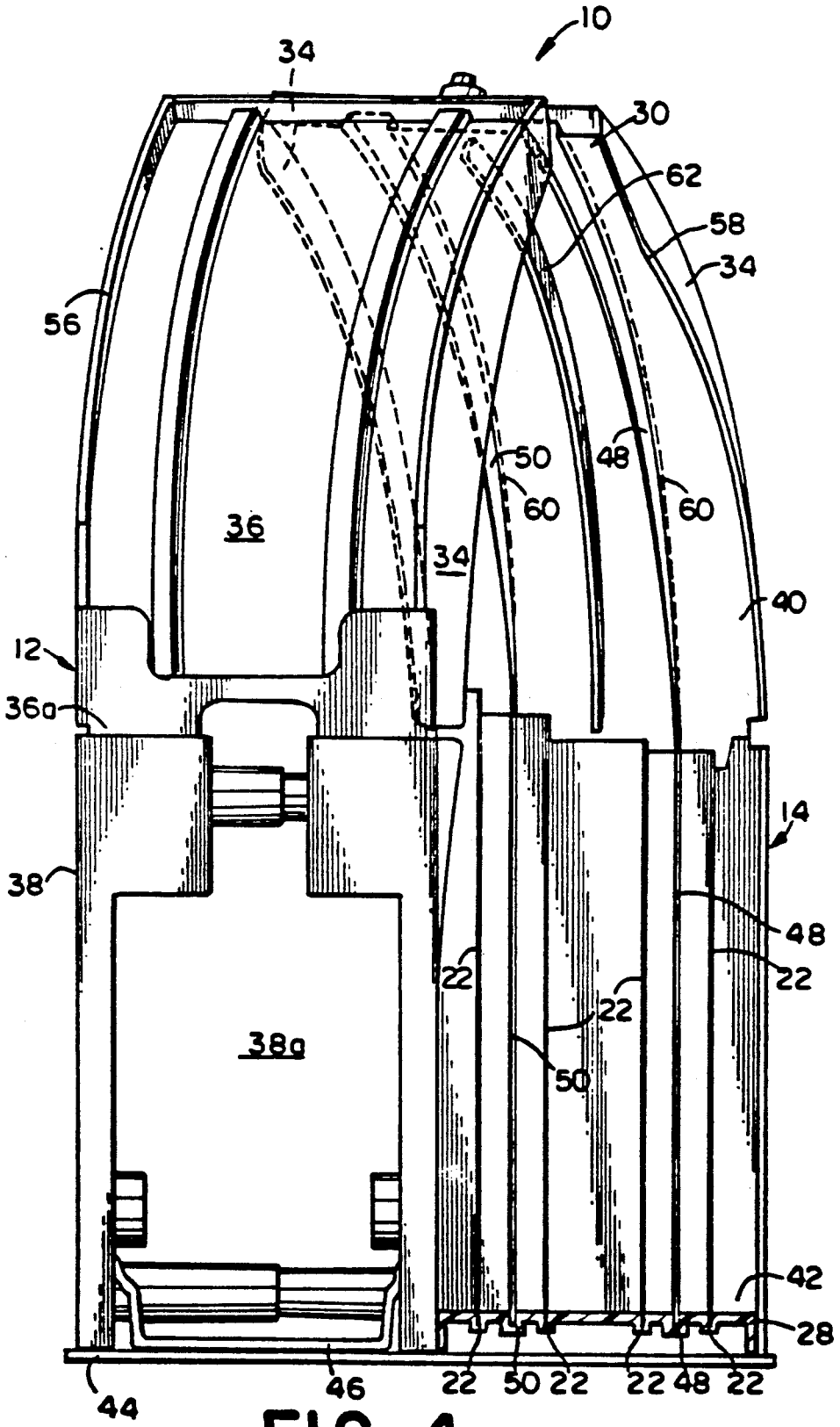
FIG. 4 is a right elevational view partially in cross section of the interrupted inverted jump loop of FIG. 1, taken along lines 4—4 of FIG. 1.

Referring now to FIGS. 1 and 4, the support member **38*a* includes means for attaching the lower portion 38 of the first slotted track 12 to the base 44. In the present embodiment, the means for attaching the lower portion 38 to the base 44 are comprised of clips 46 that extend from the base 44 and interlock with complementary structure on the interior of the support member 38*a*. It is understood by those skilled in the art that other fastening devices can be utilized for securing the lower portion 38 to the base 44, such as screws (not shown) without departing from the spirit and scope of the invention. The base 44 adds stability to the jump loop 10, which is desired when the jump loop 10** is in operation.

As shown in FIG. 1, the second slotted track 14 also includes an upper portion 40 and a lower portion 42. The upper and lower portions 40, 42 of the second slotted track 14 are preferably interconnected in a manner which is generally identical to the connection of the upper and lower portions 36, 38 of the first slotted track 12. Accordingly, further description of the connecting structure of the upper and lower portions 40, 42 of the second slotted track 14 is not believed necessary and, therefore, has been omitted and is not limiting.

In the present embodiment, the jump loop 10 is capable of handling more than one toy vehicle 18 at a time. That is, the jump loop 10 allows two electric toy vehicles to race one another. In the preferred embodiment of the invention, first and second flat sections 20, 24 of slotted track interlock with the lower portions 38, 42 of the first and second slotted tracks 12 for allowing the jump loop 10 to be readily incorporated into the remaining structure of the race track (not shown). The first and second slotted tracks 12, 14 each include a pair of spaced apart generally parallel slots 48 and 50 extending along the length thereof for receiving a pin **18*b* of the electric toy vehicle 18 to thereby catch and guide a pair of electric toy vehicles (only one is shown) through the jump loop 10, as is understood by those skilled in the art. Except for the upper portion 40 of the second slotted track 14, the slots 48 and 50** have a generally uniform width.

Referring now to FIGS. 1 and 4, the slots 48, 50 on the second slotted track 14 each have a first width at the point of reentry 30 and a second width at the point of departure 32. The first width of the slots 48, 50 is increased than the second width of the slots 48, 50 for assisting in catching the electric toy vehicle 18. That is, the first width of the slots 48, 50 is increased for allowing the second slotted track 14 to readily receive the electric toy vehicle 18 after it has traversed the interrupted portion 16. As best shown in FIG. 4, the width of the slots 48, 50 is gradually tapered between the point of reentry 30 and the point where the upper portion 40 meets the lower portion 42.

As shown in FIGS. 1 and 4, a barrier wall 62 extends radially inwardly from the upper portion 40 of the second slotted track 14. The barrier wall 62 is preferably generally equidistantly positioned between the slots 48, 50 and extends the entire length of the upper portion 40 of the second slotted track 14. The barrier wall 62 in combination with the side walls 34 aids in guiding the electric toy vehicle 18 into the correct lane upon landing and also serves to make certain that the electric toy vehicle 18 remains in their proper lane throughout the trip through the jump loop 10.

Figure 3:
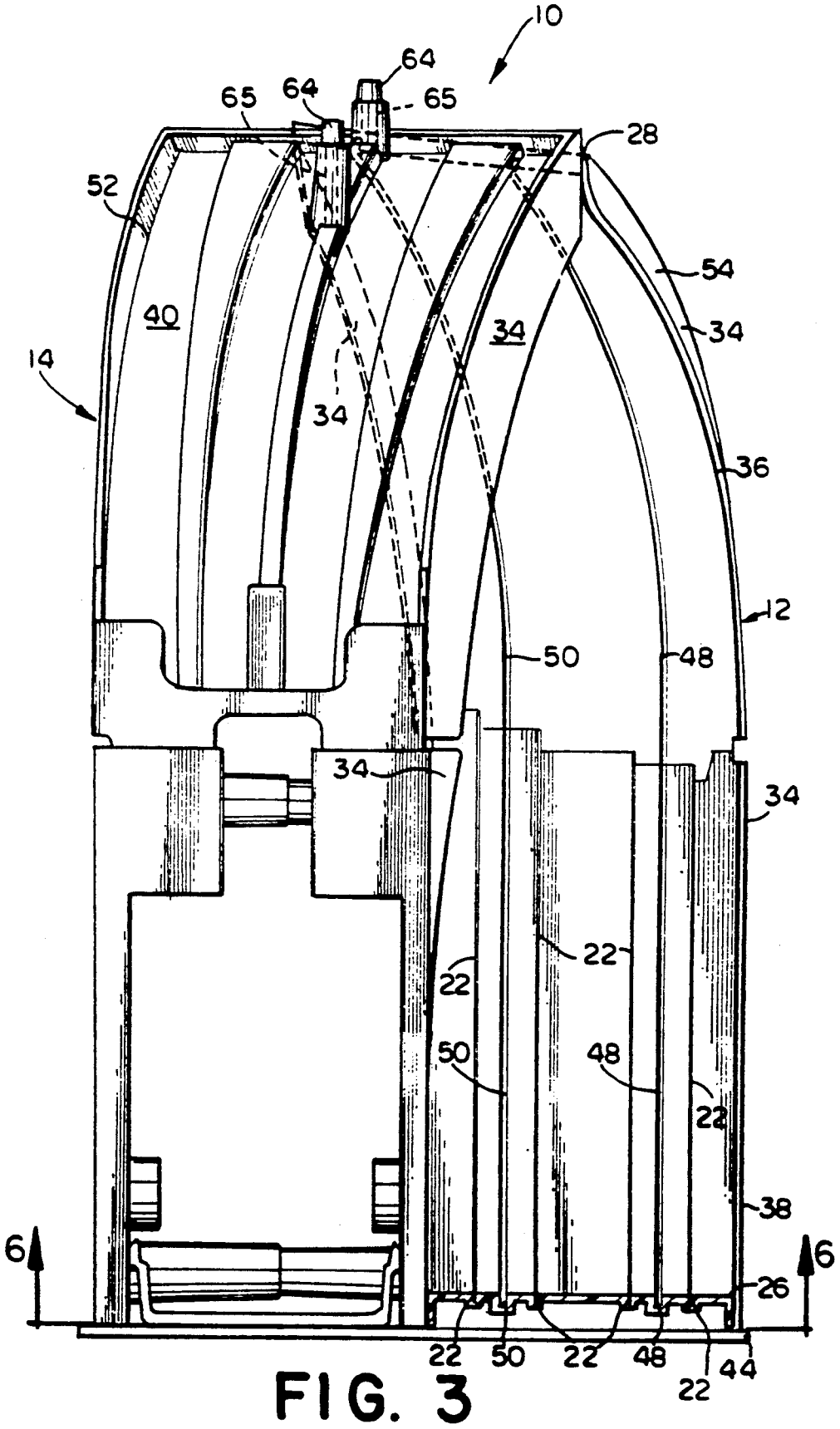
FIG. 3 is a left elevational view partially in cross section of the interrupted inverted jump loop of FIG. 1 taken along lines 3—3 of FIG. 1.

Referring now to FIGS. 1 through 3, the barrier wall 62 is securely held in place on the upper portion 40 of the second slotted track 14 by a pair of fasteners 64. The fasteners 64 include a pair of expandable legs 64*a* and 64*b* (see FIG. 2) which extending radially outwardly from the barrier wall 62. The expandable legs 64*a*, 64*b* are releasably positioned through a pair of complementarily sized apertures 65 in the upper portion 40 of the second slotted track 14 in a manner well known to those skilled in the art.

However, it is understood by those skilled in the art that the barrier wall 62 can be secured to the upper portion 40 of the second slotted track 14 in other manners. For instance the barrier wall 62 may be integrally molded as part of the upper portion 40 of the second slotted track 14 during fabrication of the upper portion 40.

Referring now to FIGS. 3 and 5, the upper portion 40 of the second slotted track 14 includes a pair of side walls 34 extending radially inwardly from the peripheral edges thereof. As mentioned previously, the barrier wall 62 is generally equidistantly spaced therebetween. However, the side walls 34 are angled outwardly away from the barrier member 62 to thereby create a pair of funnel-like lanes for receiving the electric toy vehicles 18 after they have traversed the interrupted portion 16.

Referring now to FIGS. 4 and 5, as mentioned previously, the upper portion 36 of the slotted track 12 includes a pair of slots 48, 50 extending generally along the length thereof. The slots 48, 50 are generally parallel with respect to each other at the point where the upper portion 36 meets the lower portion 38 of the first slotted track 12. However, the slots 48, 50 are angled slightly away from each other as they approach the point departure 28 for the purpose of guiding the electric toy vehicles slightly away from each other as they traverse the interrupted portion 16. That is, the slots 48, 50 guide the electric toy vehicles toward the side walls 34 of the upper portion 40 of the second slotted track 14 to insure that the electric toy vehicles 18 do not collide while they traverse the interrupted portion 16.

Referring now to FIG. 3, it is preferred that the track surface of the point of departure 28 of the first slotted track 12 be angled or twisted with respect to the track surface of the point of entry 26 of the first slotted track 12. Similarly, the track surface of the point of reentry 30 on the second slotted track 14 is twisted or angled with respect to the track surface of the point of departure 32 of the second slotted track 14 for allowing the track surface of the point of departure 28 of the first slotted track 12 to be suitably aligned with the track surface of the point of reentry 30 of the second slotted track 14. In the present embodiment, it is preferred that the angle or twist of the track surface of the point of departure 28 of the first slotted track 12 and the track surface of the point of reentry 30 of the second slotted track 14 be approximately 10° with respect to the track surface of the point of entry 26 of the first slotted track 12 and the track surface of the point of departure 32 of the second slotted track 14, respectively.

As best shown in FIG. 5, the upper portion 36 of the first slotted track 12 is angled towards the upper portion 40 of the second slotted track 14 and the upper portion 40 of the second slotted track 14 is correspondingly angled towards the upper portion 36 of the first slotted track 12 for the purpose of suitably aligning the first and second slotted tracks 12 and 14.

Referring now to FIGS. 3 and 4, in the present embodiment, it is preferred that a portion of the first and second slotted tracks 12 and 14 be electrically powered. More particularly, it is preferred that the lower portions 38, 42 of the first and second slotted tracks 12, 14 be electrically powered and the upper portions 36, 40 of the first and second slotted tracks 12, 14 be electrically powerless for allowing the electric toy vehicle 18 to freely launch from the point of departure 28 of the first slotted track 12.

In the present embodiment, it is preferred that the lower portions 38, 42 of the first and second slotted tracks 12, 14 as well as the first and second flat sections 20, 14 include electrically conductive rails 22 for providing the electric toy vehicle 18 with power. That is, the slots 48 and 50 are preferably equidistantly spaced between a pair of electrically conductive rails 22, as is understood by those skilled in the art. The electrically conductive rails 22 are preferably constructed of a high strength electrically conductive metallic material, such as steel. The electrically conductive rails 22 are preferably embedded in the track so that they ar generally flush with or extend slightly above the surface thereof for slideably receiving electric contacts 18*a* on the underside of the electric vehicle 18, as is understood by those skilled in the art. Each slot 48 and 50 has its own set of electric rails 22 to separately power an electric toy vehicle 18, so that two electric toy vehicles, each with a separately controlled source of power, may race one another, as is understood by those skilled in the art.

As best shown in FIGS. 3 and 4, the upper portion 36 of the first slotted track 12 and the upper portion 40 of the second slotted track 14 do not include electrically conductive rails 22. Thus, the electric toy vehicle 18 coasts through this portion of the jump loop !0 since it is not electrically powered. This is an important feature of the present invention because it allows the electric toy vehicle 18 to traverse the interrupted portion 16 without spinning about its longitudinal axis, as described in more detail hereinafter.

Figure 6:
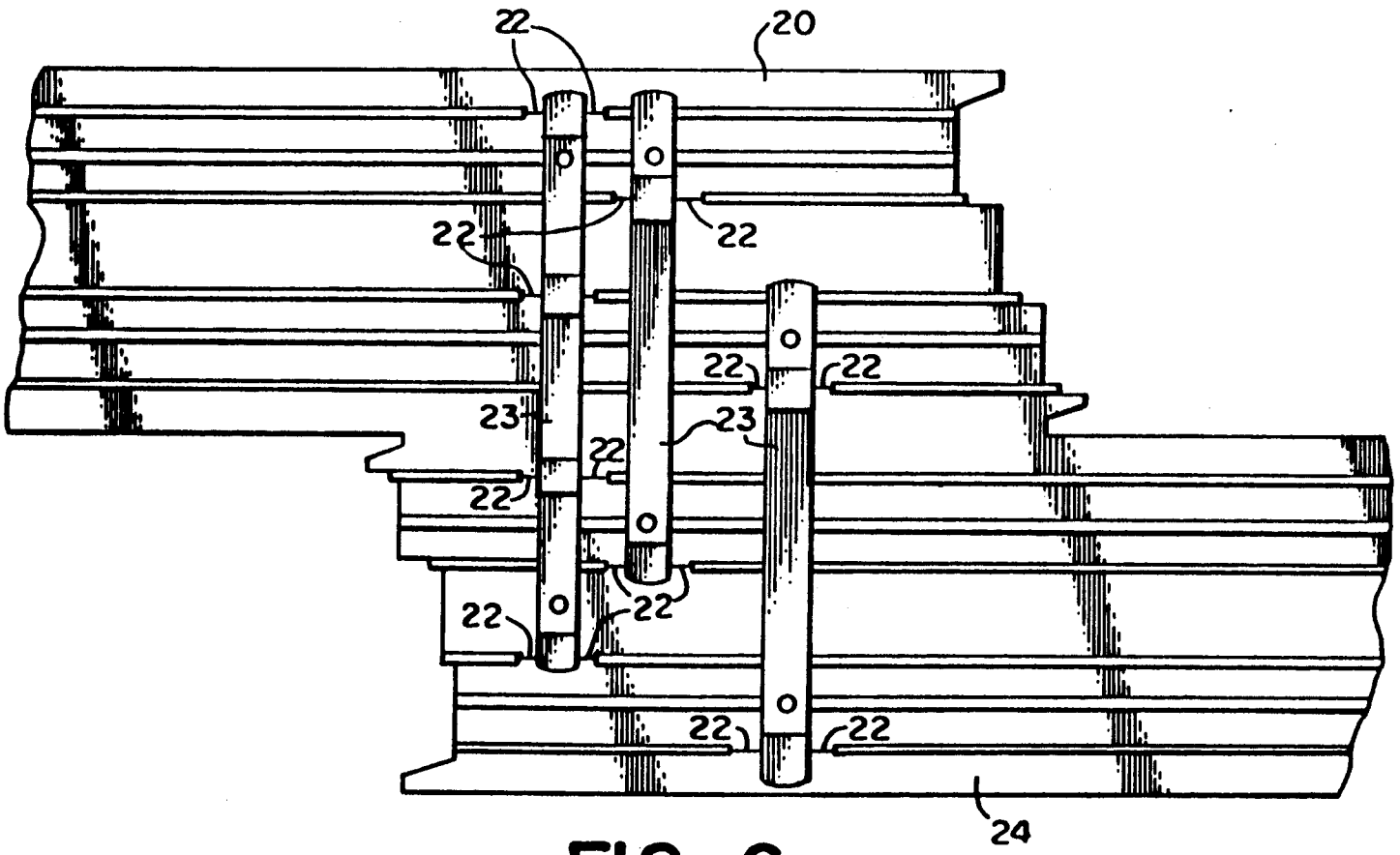
FIG. 6 is a cross-sectional view of the interrupted inverted jump loop shown in FIG. 3 taken along line 6—6 of FIG. 3.

Referring now to FIGS. 5 and 6, the first flat section of electrically powered slotted track 20 is in complementary electrical engagement with the lower portion 38 of the first arcuate slotted track 12. Similarly, the second flat section of electrically powered slotted track 24 is in complementary electrical engagement with the lower portion 42 of the second arcuate slotted track 14. In the present embodiment, the adjacent lateral sides of the first and second flat sections 20, 24 are preferably integrally connected during the injection molding process to thereby create a single piece.

Since the jump loop 10 includes the interrupted portion 16 and the upper portions 36, 40 thereof are not electrically powered, in order to complete the circuit for the electric toy track, it is necessary to electrically interconnect the electrically conductive rails 22 of the first flat section 20 to the electrically conductive rails 22 of the second flat section 24. Referring now to FIG. 6, in the present embodiment, electrically conductive means are interconnected between the first and second flat sections of electrically powered slotted track 20, 24 for allowing electric current to pass therebetween In the present embodiment, the electrically conductive means is comprised of three electrically conductive strips 23 secured to the underside of the first and second flat sections of track 20, 24 between the electrically conductive rails 2 thereof.

As best shown in FIG. 6, the underside of the first and second flat sections 20, 24 includes gaps where the electrically conductive rails 22 are exposed. This allows the electrically conductive strips 23 to be interconnected therebetween to complete the circuit in a manner well known to those skilled in the art. In the present embodiment, the electrically conductive strips 23 are formed of an electrically conductive material, such as steel. The electrically conductive strips 23 are formed to weave across the bottom of the first and second flat sections 20, 24 into engagement with the appropriate electrically conductive rail 22.

While in the present embodiment it is preferred that electrically conductive strips 23 be utilized to electrically connect the first flat section 20 to the second flat section 22, it is understood by those skilled in the art that other means could be used for completing the circuit For instance, electrically conductive wire (not shown) could be electrically connected to the pertinent electrically conductive rails 22 as desired.

Referring now to FIG. 1, in operation, the electric toy vehicle 18, powered by the electrically conductive rails 22, moves in the direction of the arrow 19 on the first flat section of track 20 towards the first slotted track 12. The electric toy vehicle 18 preferably enters the lower portion 38 of the first slotted track 12 under power. The electric toy vehicle 18 proceeds up the lower portion 38 of the first slotted track 12 under power until it reaches the upper portion 36 of the first slotted track 12.

Since the electric toy vehicle 18 is under power when it enters the upper portion 36 of the first slotted track 12, the armature (not shown) thereof is rotating at the relatively high revolutions per minute. As electric toy vehicle 18 travels through the upper portion 36, the revolutions per minute of the armature begin to decrease. The arcuate length of the upper portion 36 is selected such that the revolutions per minute of the armature are sufficiently reduced when the electric toy vehicle 18 reaches the point of departure 28 so that the effects of motor steer are sufficiently reduced to allow the electric toy vehicle 18 to traverse the interrupted portion 16 without twisting or spinning about its longitudinal axis.

When the electric toy vehicle 18 leaves or is launched from the point of departure 28 of the first slotted track 12, it is in an upside-down position The electric toy vehicle 18 remains in the same upside-down position as it traverses through the interrupted portion 16. After traversing through the interrupted portion 16, the toy vehicle 18 is received or caught while still in its upside-down position by the upper portion 40 of the second slotted track 14. The toy vehicle 18 then proceeds down the arcuate curve section of the second slotted track 14, gradually returning to an upright position, so that by the time the toy vehicle 18 reaches the second flat section 24 it is in an upright position. Upon reaching the second flat section 24, the electric toy vehicle 18 proceeds onward to the remainder of the electric slotted track which eventually returns the toy vehicle 18 to the first flat section 20.

Thus, the present invention provides an interrupted inverted jump loop 10 for an electric toy track, in which an electric toy vehicle is launched into the air to carry out an upside-down free-flying jump. While the above described operation of the jump loop 10 pertains to only a single electric toy vehicle 18, it is understood that the jump loop 10 preferably simultaneously handles a pair of electric toy vehicles, one in each slot 48, 50. Thus, children using the present invention can race a pair of electric toy vehicles against one another and, while racing, both electric toy vehicles can carry out an upside-down free-flying jump simultaneously.

While it is preferred that the first and second slotted tracks 12, 14 include slots 48, 50 for guiding the electric toy vehicle 18 through the jump loop 10, it is understood by those skilled in the art that the first and second tracks 12 and 14 could be slotless. That is, since the electric rails 22 do not extend through the upper portions 36, 40 of the first and second tracks 12, 14, the jump loop 10 is equally applicable to electric toy tracks which do not utilize slots.

From the foregoing description, it can be seen that the present invention comprises an interrupted inverted jump loop for an electric toy vehicle track in which an electric toy vehicle is launched into the air and then caught by the track after it is traversed through the air. It will be appreciated by those skilled in the art that the changes and modifications may be made to the above-described embodiment without departing from the inventive concept thereof It is understood, therefore, that the present invention is not limited to the particular embodiment disclosed, but it is intended to include all modifications and changes which are within the scope and spirit of the invention as defined by the appended claims.

We claim:

1. An interrupted inverted jump loop for an electric toy vehicle track, said interrupted inverted jump loop comprising:

a first generally arcuate slotted track forming a first portion of said interrupted inverted jump loop for launching an electric toy vehicle into the air to carry out an upside-down free-flying jump, said first slotted track including a point of entry having a predetermined width and point of departure having a predetermined width; and a second generally arcuate slotted track forming a second portion of said interrupted inverted jump loop, said second generally arcuate slotted track including a point of entry having a predetermined width and a point of departure having a predetermined width, said point of reentry of said second slotted track being spaced from and aligned with the point of departure of said first slotted track, said first slotted track and said second slotted track being in facing relationship thereby forming an interrupted inverted loop for catching said upside-down electric toy vehicle after it has traversed through the air.

2. The interrupted inverted jump loop as recited in claim 1, wherein the width of the first slotted track at said point of departure is greater than the width of the first slotted track at said point of entry.

3. The interrupted inverted jump loop as recited in claim 2, wherein the first slotted track has a length and a pair of spaced apart generally parallel slots extending along the length of the track for launching a pair of electric toy vehicles.

4. The interrupted inverted jump loop as recited in claim 1, further comprising an electrical conductor for conducting an electric current through a portion of said first and second slotted tracks.

5. The interrupted inverted jump loop as recited in claim 4, wherein the first and second slotted tracks have upper and lower portions, said lower portion of said first slotted track including said electrical conductor and said upper portion of said first slotted track not including said electrical conductor such that said electric toy vehicle freely launches from said point of departure.

6. The interrupted inverted jump loop as recited in claim 5 further including:

a first generally flat section of electrically conductive slotted track electrically connected to said lower portion of said first arcuate slotted track;

a second generally flat section of electrically conductive slotted track electrically connected to said lower portion of said second arcuate slotted track; and electrically conductive means interconnected between said first and second flat sections of electrically powered slotted track for allowing electrical current to pass therebetween.

7. The interrupted inverted jump loop as recited in claim 1, wherein the width of the second slotted track at said point of reentry is greater than the width of the second slotted track at said point of departure.

8. The interrupted inverted jump loop as recited in claim 7, wherein the second slotted track has a length and a pair of spaced apart generally parallel slots extending along the length of the track for catching a pair of electric toy vehicles.

9. The interrupted inverted jump loop as recited in claim 8, wherein each slot has a first width at the point of reentry and a second width at the point of departure, said first width of said slots being greater than the second width of said slots for assisting in catching said electric toy vehicles.

10. The interrupted inverted jump loop as recited in claim 9, further including a wall extending outwardly from said second slotted track, said wall being generally equidistantly positioned between said slots.

11. The interrupted inverted jump loop as recited in claim 9, wherein the point of departure of the first slotted track has a track surface which is angled with respect to a track surface of the point of entry of the first slotted track.

12. The interrupted inverted jump loop as recited in claim 11, wherein the angle is approximately 10°.

13. An interrupted inverted jump loop for an electric toy vehicle track, said interrupted inverted jump loop comprising:

a first generally arcuate track forming a first portion of said interrupted inverted jump loop for launching an electric toy vehicle into the air to carry out an upside-down free-flying jump, said first track having an upper portion and a lower portion, said lower portion including an electrical conductor, said upper portion not including an electrical conductor such that said electric toy vehicle freely launches from said first track; and a second generally arcuate track forming a second portion of said interrupted inverted jump loop, said first slotted track and said second slotted track being in facing relationship and said second slotted track being spaced from and aligned with said first track thereby forming an interrupted inverted loop for catching said electric toy vehicle after it has traversed through the air.

* * * * *